US011830457B2

(12) United States Patent
Choi et al.

(10) Patent No.: US 11,830,457 B2
(45) Date of Patent: Nov. 28, 2023

(54) ADJUSTING PEAK SIGNAL IN TRANSITIONAL FRAME

(71) Applicant: Google LLC, Mountain View, CA (US)

(72) Inventors: Sangmoo Choi, Palo Alto, CA (US); John William Kaehler, Mountain View, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/758,533

(22) PCT Filed: Aug. 28, 2020

(86) PCT No.: PCT/US2020/070479
§ 371 (c)(1),
(2) Date: Jul. 8, 2022

(87) PCT Pub. No.: WO2022/046156
PCT Pub. Date: Mar. 3, 2022

(65) Prior Publication Data

US 2023/0005449 A1 Jan. 5, 2023

(51) Int. Cl.
*G09G 5/10* (2006.01)

(52) U.S. Cl.
CPC ..... *G09G 5/10* (2013.01); *G09G 2320/041* (2013.01); *G09G 2340/0435* (2013.01); *G09G 2360/16* (2013.01)

(58) Field of Classification Search
CPC ..... G09G 5/10
See application file for complete search history.

(56) References Cited

U.S. PATENT DOCUMENTS

| | | | |
|---|---|---|---|
| 8,692,933 | B1 | 4/2014 | Namboodri |
| 2014/0267448 | A1 | 9/2014 | Albrecht et al. |
| 2016/0196802 | A1 | 7/2016 | Nho et al. |
| 2017/0116933 | A1 | 4/2017 | Xu |
| 2018/0082634 | A1 | 3/2018 | Wang et al. |

FOREIGN PATENT DOCUMENTS

| | | | |
|---|---|---|---|
| CN | 110751933 | A | 2/2020 |
| CN | 111312191 | A | 6/2020 |

OTHER PUBLICATIONS

International Search Report and Written Opinion for PCT Application No. PCT/US2020/070479, dated Apr. 23, 2021, 15 pages.
International Preliminary Report on Patentability in International Appln. No. PCT/US2020/070479, dated Mar. 9, 2023, 12 pages.

*Primary Examiner* — Gustavo Polo
(74) *Attorney, Agent, or Firm* — Fish & Richardson P.C.

(57) ABSTRACT

A non-transitory computer-readable storage medium comprising instructions stored thereon. When executed by at least one processor, the instructions can be configured to cause a computing device to, in response to an instruction to transition from a first refresh rate to a second refresh rate, modify a transitional frame. The modifying the transitional frame can include refreshing a first row in a display with a first adjustment to a peak signal of at least one pixel in the first row, and refreshing a second row in the display with a second adjustment to a peak signal of at least one pixel in the second row, the second row being refreshed after the second row, the second adjustment being greater than the first adjustment.

20 Claims, 13 Drawing Sheets

ADJUSTING PEAK SIGNAL IN TRANSITIONAL FRAME

CROSS-REFERENCE TO RELATED APPLICATION

This application is a 35 U.S.C. § 371 National Stage Entry Application from PCT/US2020/070479, filed on Aug. 28, 2020, entitled "ADJUSTING PEAK SIGNAL IN TRANSITIONAL FRAME", the disclosure of which is incorporated herein by reference in its entirety.

TECHNICAL FIELD

This description relates to displays on computing devices.

BACKGROUND

Displays for computing devices can have modifiable refresh rates, or rates of updating or changing pixel content. Lower refresh rates can reduce power consumption, increasing battery life, whereas higher refresh rates can improve graphical output.

SUMMARY

According to a first example, a non-transitory computer-readable storage medium comprising instructions stored thereon. When executed by at least one processor, the instructions can be configured to cause a computing device to, in response to an instruction to transition from a first refresh rate to a second refresh rate, modify a transitional frame. The modifying the transitional frame can include refreshing a first row in a display with a first adjustment to a peak signal of at least one pixel in the first row, and refreshing a second row in the display with a second adjustment to a peak signal of at least one pixel in the second row, the second row being refreshed after the second row, the second adjustment being greater than the first adjustment.

The transitional frame may include a last frame displayed at the first refresh rate before transitioning from the first refresh rate to the second refresh rate.

The adjustment to the peak signal of the at least one pixel in the second row may cause an average luminance of the at least one pixel in the second row to be equal to a predicted average luminance that the at least one pixel in the second row would have had if the first refresh rate had been maintained and the peak signal of the at least one pixel in the second row had not been adjusted.

The transitional frame may include a first frame displayed at the second refresh rate after transitioning from the first refresh rate to the second refresh rate.

The instructions may be further configured to cause the computing device to display a bundled frame after receiving the instruction to transition from the first refresh rate to the second refresh rate, and the bundled frame may have the first refresh rate and may immediately precede the transitional frame.

The adjustment to the peak signal of the at least one pixel in the second row may cause an average luminance of the at least one pixel in the second row during the transitional frame and the bundled frame to be equal to a predicted average luminance that the at least one pixel in the second row would have had if the first refresh rate had been maintained and the peak signal of the at least one pixel in the second row had not been adjusted.

A distance between the second row and a top portion of the display may be greater than a distance between the first row and the top portion of the display.

The first adjustment may be zero, and modifying the transitional frame may further include refreshing a third row in the display with a third adjustment to a peak signal of at least one pixel in the third row, the third row being refreshed after the second row, the third adjustment being greater than the second adjustment.

A sign of the second adjustment may be based on an encoded intensity of the at least one pixel in the second row.

The second adjustment may be based on a location in the display of the second row and an encoded intensity of the at least one pixel in the second row.

The second adjustment may be based on a location in the display of the second row, an encoded intensity of the at least one pixel in the second row, and a measured temperature of the display.

The second adjustment may be based on a location in the display of the second row and a measured temperature of the display.

The second refresh rate may be greater than the first refresh rate, and the second adjustment may be a negative value.

The second refresh rate may be greater than the first refresh rate, an encoded intensity of the at least one pixel in the second row may be within a high luminance range, and the second adjustment may be a negative value.

The second refresh rate may be greater than the first refresh rate, an encoded intensity of the at least one pixel in the second row may be within a low luminance range, and the second adjustment may be a positive value.

An encoded intensity of the at least one pixel in the second row may be within a medium luminance range, and the second adjustment may be zero.

According to a second example, a computing device can include at least one processor and a non-transitory computer readable storage medium. The non-transitory computer-readable storage medium can include instructions stored thereon. When executed by the at least one processor, the instructions can be configured to cause the computing device to, in response to an instruction to transition from a first refresh rate to a second refresh rate, modify a transitional frame. The modifying the transitional frame can include refreshing a first row in a display with a first adjustment to a peak signal of at least one pixel in the first row, and refreshing a second row in the display with a second adjustment to a peak signal of at least one pixel in the second row, the second row being refreshed after the second row, the second adjustment being greater than the first adjustment.

The non-transitory computer-readable storage medium may be the non-transitory computer-readable storage medium described above in the first example, and may comprise any one, more, or all of its features. The computing device may comprise a display for displaying frames, in particular, any one of more of the first frame, the second frame, the transitional frame, and the bundled frame.

The details of one or more implementations are set forth in the accompanying drawings and the description below. Other features will be apparent from the description and drawings, and from the claims. Any feature(s) described herein in relation to one aspect, embodiment, example or implementation may be combined with any other feature(s) described herein in relation to any other aspect, embodiment, example or implementation as appropriate and applicable.

Like reference numbers refer to like elements. In the following description, where relative terms, such as "top", "topmost", "bottom", "bottommost", "higher" and "lower" are used with reference to a display, device, system, feature thereof and/or otherwise, these may refer to the "top", "bottom" etc. of the relevant display, device, system, feature thereof etc. when it is in the orientation in which it is intended to be used and/or viewed by a user.

DETAILED DESCRIPTION

A refresh rate of a display can represent a rate at which rows of pixels in the display are refreshed, and/or receive signals that cause the pixels to generate an image. A higher refresh rate can improve image quality in applications in which the image changes, such as video applications or video game applications. A lower refresh rate can reduce power consumption.

Rows of pixels can be refreshed sequentially during a frame. When a computing device and/or display transitions from a first refresh rate to a second refresh rate, the time delay for refreshing rows can be different for different rows, as shown graphically in FIG. 4A. The different time delays can cause different rows to have different average luminances, causing the display to appear to flicker. To maintain same average luminances, and/or reduce the appearing of flickering, the computing device can adjust the signals sent and/or provided to the rows of pixels. The adjustment can vary based on which row the signals are sent to.

The average luminance may be an average taken across the time period between the at least one pixel in the second row receiving the adjusted peak signal in the transitional frame and the at least one pixel in the second row receiving the peak signal in the next frame in the sequence. The next frame in the sequence may be the second frame. The average luminance may be an average across a transitional frame (described below) and the next frame in the sequence. The average luminance may be an average across the transitional frame and the frame after and/or following the transitional frame.

Figure 1A:
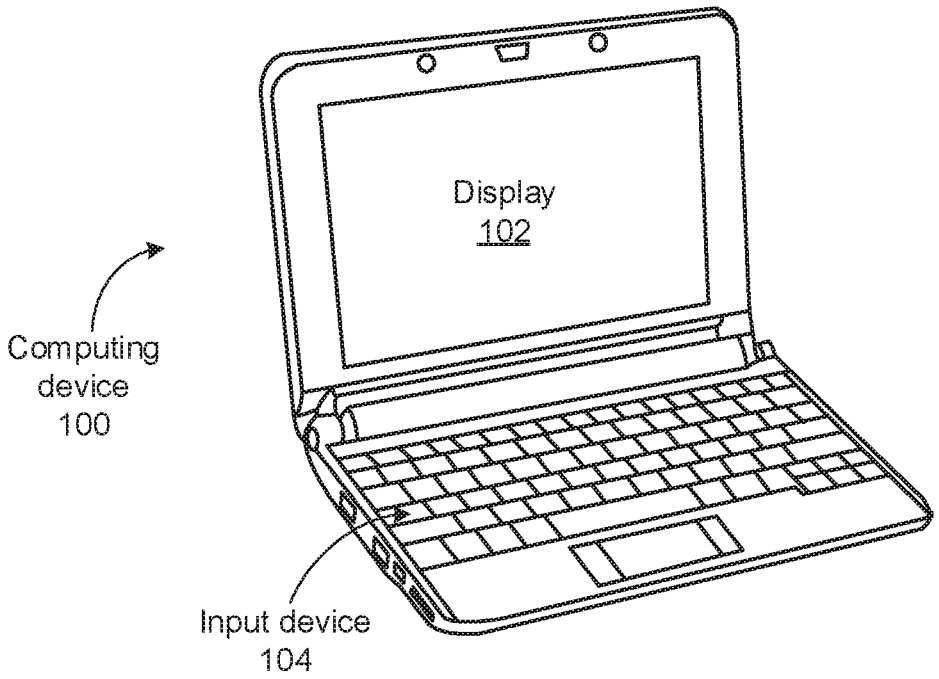
FIG. 1A is a diagram of a computing device according to an example implementation.

FIG. 1A is a diagram of a computing device 100 according to an example implementation. The computing device 100 can include a display 102 and an input device 104. The display 102 can present, provide, output, and/or display graphical and/or visual output. In some examples, the display 102 can include a touchscreen display that receives touch input, such as a capacitive touchscreen display and/or a resistive touchscreen display. The display 102 can include a light-emitting diode (LED) display, such as an organic LED (OLED) display and/or active-matrix organic LED (AMOLED) display, as non-limiting examples.

The input device 104 can receive input from a user. The input device 104 can include, for example, a keyboard, a trackpad, or a home button, as non-limiting examples.

Figure 1B:
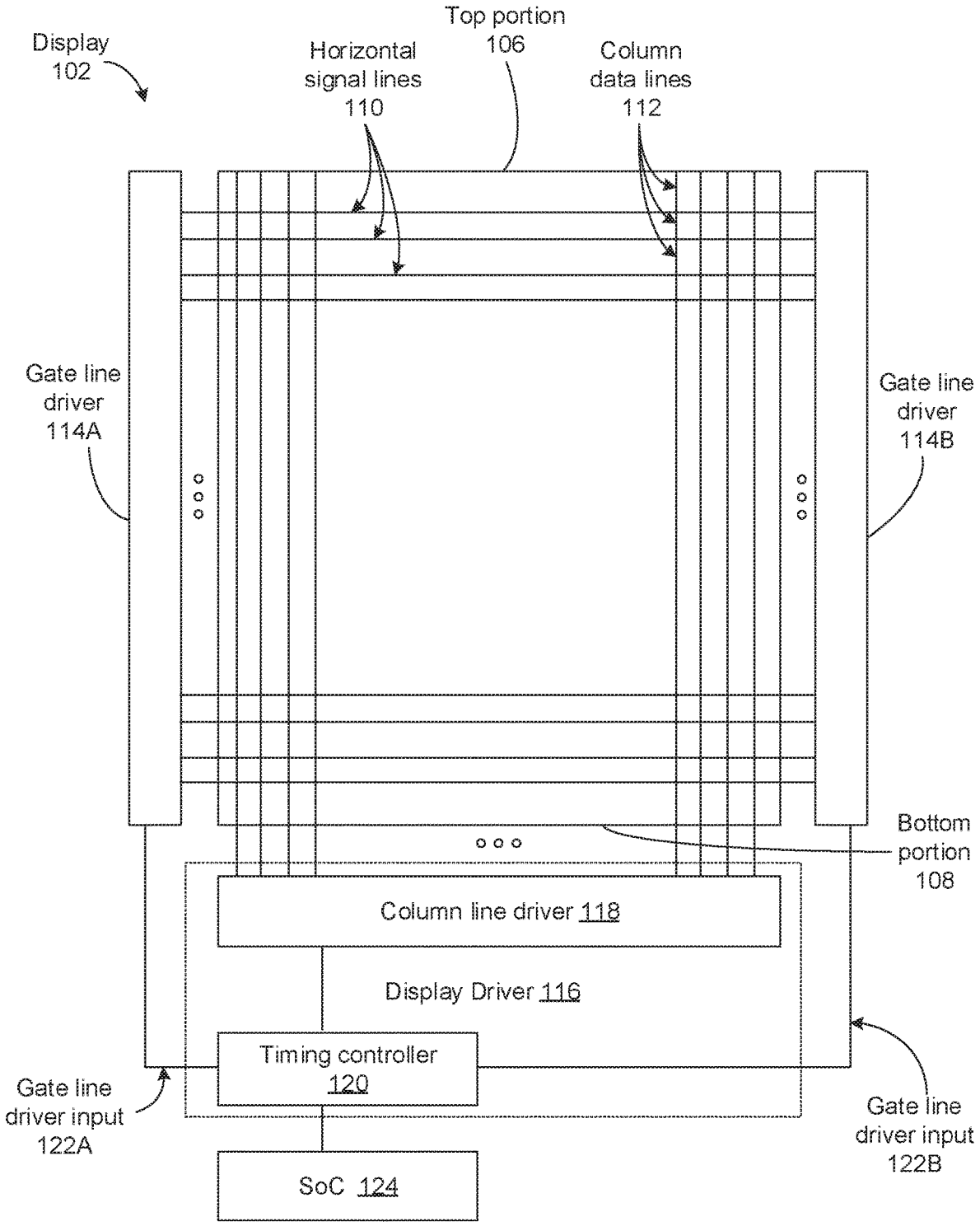
FIG. 1B is a diagram of a display included in the computing device of FIG. 1A according to an example implementation.

FIG. 1B is a diagram of the display 102 included in the computing device 100 of FIG. 1A according to an example implementation. The display 102 can include an array of pixels having rows and columns. The display 102 can include multiple horizontal signal lines 110. Horizontal may refer to their position when the computing device 100 is in the orientation in which it is intended to be used. The horizontal signal lines 110 can provide signals to rows of pixels. The horizontal signals lines 110 and/or rows of pixels can be numbered sequentially from a top portion 106 of the display 102 to a bottom portion 108 of the display 102. The top portion 106 of the display 102 refers to the top portion of the display 102 when the display 102 is in the orientation in which it is to be viewed by a user.

During each frame, the horizontal signal lines can sequentially and/or successively provide signals to the rows of pixels, with the first and/or topmost row of pixels receiving signals at or near a beginning of the frame and the last and/or the lower-most and/or bottommost row of pixels receiving signals at or near an end of the frame. The display 102 can include gate line drivers 114A, 114B that provide signals to the horizontal signal lines 110.

The display can include column data lines 112. The column data lines 112 can provide signals to columns of pixels. The horizontal signal lines 110 and column data lines 112 can combine to provide signals to individual pixels on the display 102, causing the individual pixels to emit a specific light seen by a user. The display 102 can include a column line driver 118 that provides signals to the column data lines 112.

The display 102 can include a display driver 116. The display driver 116 can be included on an integrated circuit. The display driver 116 can control the output of the display 102, such as by providing input to the horizontal signal lines 110 via the gate line drivers 114A, and/or by providing input to the column data lines 112 via the column line driver 118.

The display driver 116 can include a timing controller 120. The timing controller 120 can generate and/or provide signals to the horizontal signal lines 110 via the gate line drivers 114A and/or column data lines 112 via the column line driver 118. The signals can include clock signals and/or start pulses. The signals generated and/or provided by the timing controller 120 can instruct and/or prompt the horizontal signal lines 110 and/or column data lines 112 to refresh and/or update the image presented by the pixels, such as by sending signals to the pixels. The timing controller 120 can send and/or provide the signals to the gate line drivers 114A, 114B via gate line driver input lines 122A, 122B included in the display 102.

The display 102 can include a system on a chip (SoC) 124. The SoC 124 can receive instructions from a processor of the computing device 100 and provide instructions to the display driver 116 based on the instructions received from the processor.

Figure 2A:
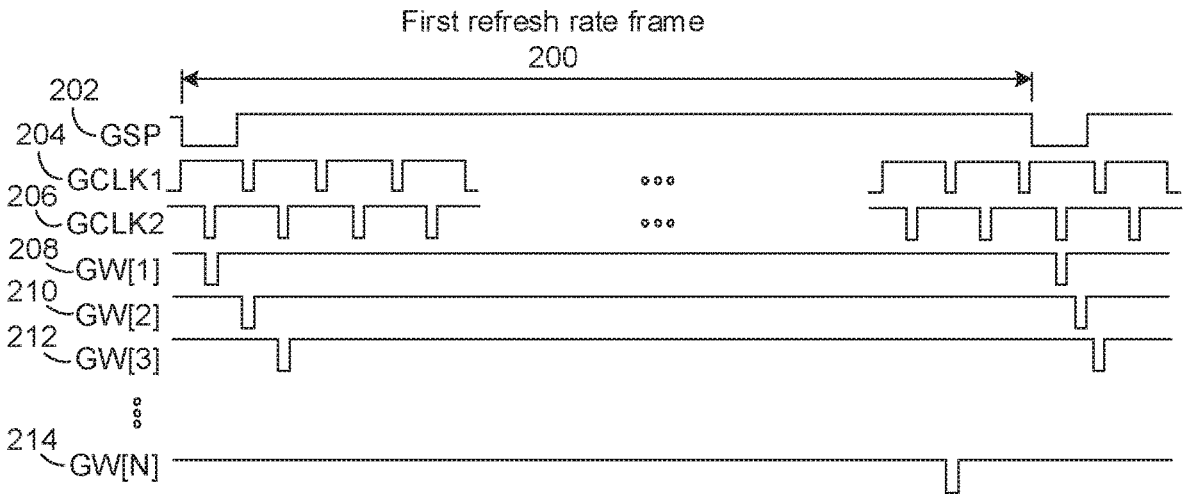
FIG. 2A shows clock signals and row scanning signals at a first refresh rate according to an example implementation.

FIG. 2A shows clock signals and row scanning signals at a first refresh rate according to an example implementation. In some examples, the first refresh rate is sixty Hertz (60 Hz). A gate start pulse (GSP) 202 can include one signal or pulse at the beginning of each first refresh rate frame 200. A first gate clock (GCLK1) 204 can include a number of signals or pulses per first refresh rate frame 200 equal to the first refresh rate, spaced at equal intervals throughout the first refresh rate frame 200. A second gate clock (GCLK2) 206 can include signals or pulses that are 180 degree phase shifted from the signals or pulses of the GCLK1 204. The GCLK1 204 and/or GCLK2 206 can be generated by the timing controller 120 shown and described with respect to FIG. 1B.

The gate line drivers 114A, 114B can generate N row signals and/or pulses (GW[1] 208, GW[2] 210, GW[3] 212, GW[N] 214) for the horizontal signal lines 110, where N is the number of horizontal signal lines 110 included in the display 102. As shown in in FIG. 2A, the signals and/or pulses are shifted and/or offset in time as the row number increases. In some examples, the pulse and/or signal for the first row GW[1] 208, which can be at or near the top portion 106 of the display 102, is at or near a beginning of the first refresh rate frame 200, and the pulse and/or signal for the last row GW[N] 214, which can be at or near the bottom portion 108 of the display 102, is at or near an end of the first refresh rate frame 200. The pulses and/or signals of the intermediary rows GW[2] 210, GW[3] 212 can be sequentially spaced between the pulses and/or signals of the first row GW[1] 208 and last row GW[N] 214.

Figure 2B:
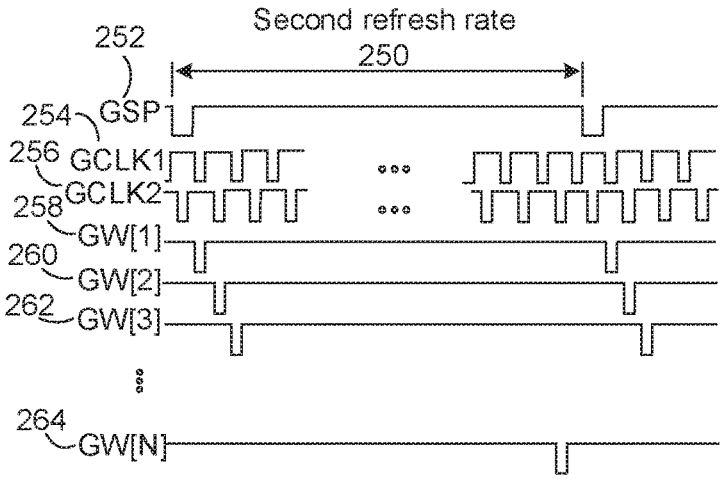
FIG. 2B shows clock signals and row scanning signals at a second refresh rate according to an example implementation.

FIG. 2B shows clock signals and row scanning signals at a second refresh rate according to an example implementation. In some examples, the second refresh rate can be greater than the first refresh rate, such as one hundred and twenty Hertz (120 Hz), causing a period of time of a second refresh rate frame 250 to be shorter than the first refresh rate frame 200, such as half the length of the first refresh rate frame 200. The greater frequency of the second refresh rate, and/or shorter period of the second refresh rate frame 250, can cause a GSP 252, GCLK1 254, GCLK2 256, GW[1] 258, GW[2] 260, GW[3] 262, through a GW[N] 264 to have greater frequencies than, but otherwise have similar features and/or characteristics as, the GSP 202, GCLK1 204, GCLK2 206, GW[1] 208, GW[2] 210, GW[3] 212, through a GW[N] 214, respectively. As GCLK1 254 and GCLK2 256 in FIG. 2B have twice the frequency of GCLK1 204 and GCLK2 206 in FIG. 2A, the propagation speed of GW from the first pixel row to the last pixel row in FIG. 2B is also twice as fast as the propagation speed from the first pixel row to the last pixel row in FIG. 2A.

Figure 3A:
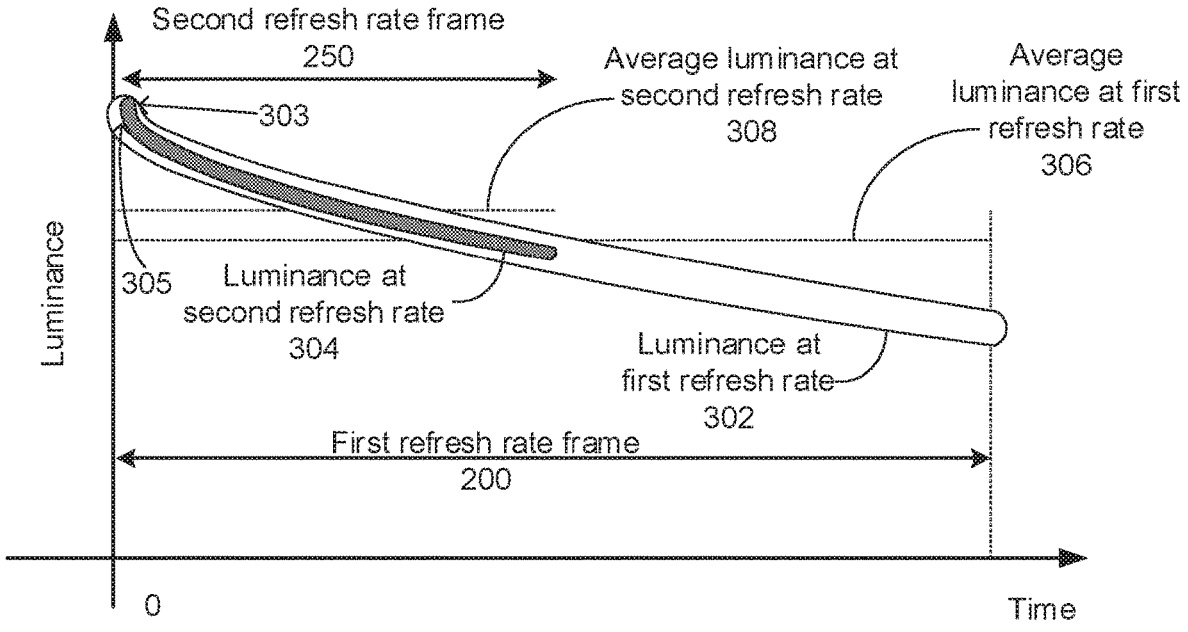
FIG. 3A shows luminance values for a pixel at a first refresh rate and a second refresh rate according to an example implementation.

FIG. 3A shows luminance values for a pixel at a first refresh rate and a second refresh rate according to an example implementation. The time shown in FIG. 3A is relative to the time of a pixel row being updated to a new image in response to the row signals and/or pulses 208, 210, 212, 214, 258, 260, 262, 264. In some examples, as used herein, a "first refresh rate" can correspond to the first refresh rate frame 200 and pulses GW[1] 208, GW[2] 210, GW[3] 212, through GW[N] 214 shown in FIG. 2A, and a "second refresh rate" can correspond to the second refresh rate frame 250 and pulses GW[1] 208, GW[2] 210, GW[3] 212, through GW[N] 214 shown in FIG. 2B, although the second refresh rate does not need to be exactly twice the first refresh rate.

In the example shown in FIG. 3A, the luminance 302, 304 declines after the peak luminance 303, 305 for both the first refresh rate and the second refresh rate. However, at the second refresh rate, which is higher than the first refresh rate, the luminance 308 stops declining and returns to the peak luminance sooner when the next frame starts. The shorter period of declining luminance 304 for the second refresh rate, as compared with the period of declining luminance 302 for the first refresh rate, causes an average luminance at the second refresh rate 308 to be higher and/or greater than the average luminance at the first refresh rate 306. The mismatch of the average luminance 306, 308 between two different refresh rates causes optical artifacts in the display 102 while the display 102 is dynamically transitioning the refresh rate.

Figure 3B:
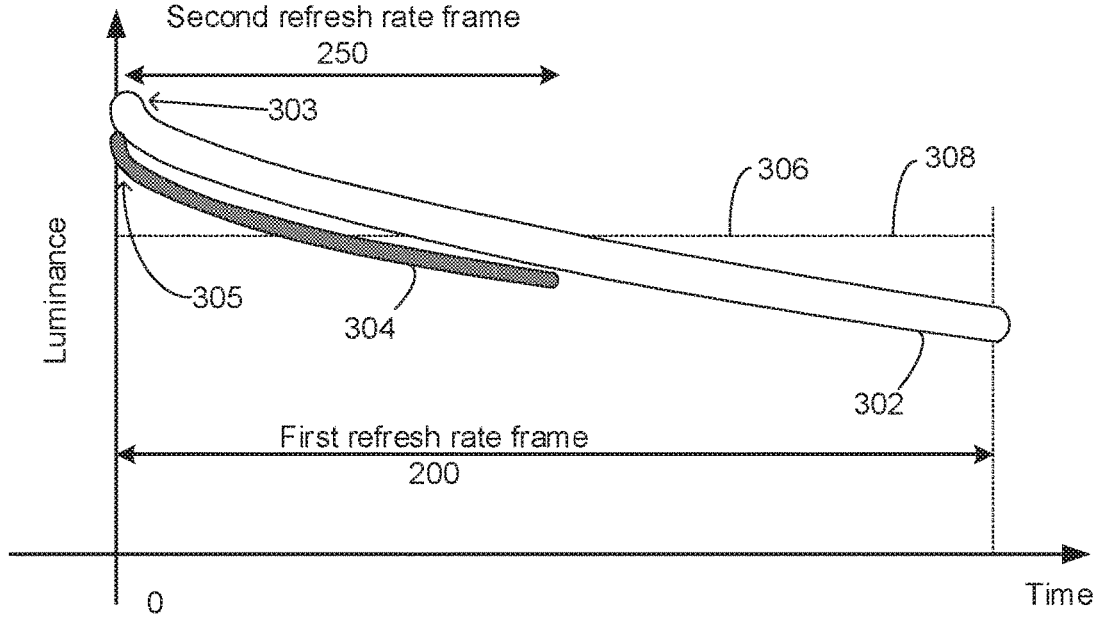
FIG. 3B shows luminance values for a pixel at a first refresh rate and a second refresh rate according to another example implementation.

FIG. 3B shows luminance values for a pixel at the first refresh rate and the second refresh rate according to another example implementation. As in the example shown in FIG. 3A, the luminance at the second refresh rate 304 stops declining and returns to the peak sooner than the luminance at the first refresh rate 302. However, in this example, the peak luminance 305 at the second refresh rate is adjusted downward and/or is reduced compared to and/or relative to the peak luminance 303 at the first refresh rate. The downward adjustment of the peak luminance 305 at the second refresh rate causes the average luminance at the second refresh rate 308 to be equal to, and/or the same as, the average luminance at the first refresh rate 306. The downward adjustment of the peak luminance 305 can mitigate the optical artifacts caused by the luminance mismatches between different refresh rates.

Figure 4A:
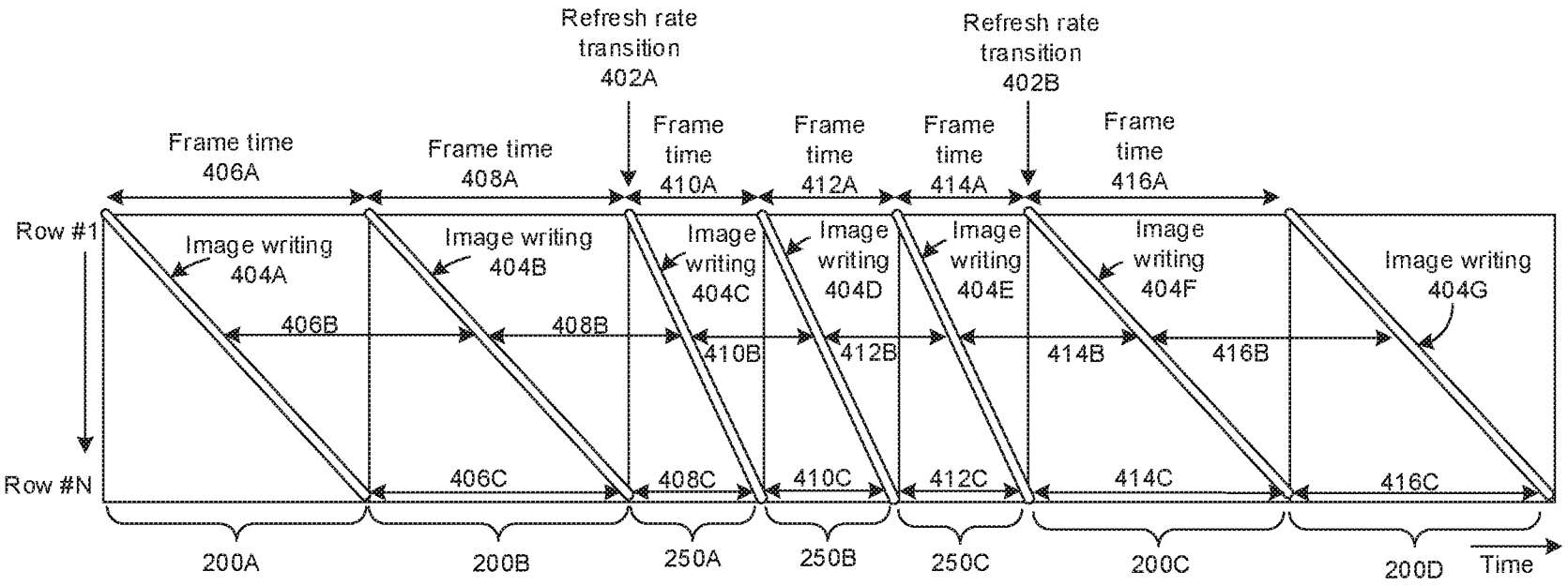
FIG. 4A shows refresh rate transitions and row line scanning according to an example implementation.

FIG. 4A shows refresh rate transitions 402A, 402B and row line scanning according to an example implementation. The row line scanning is represented by image writing 404A, 404B, 404C, 404D, 404E, 404F, 404G in FIG. 4A. In the example shown in FIG. 4A, the refresh rate transition 402A represents a transition from a first refresh rate to a second refresh rate, and the refresh rate transition 402B represents a transition from the second refresh rate back to the first refresh rate. The computing device 100 can implement the refresh rate transitions 402A, 402B in response to instructions to transition from the first refresh rate to the second refresh rate and back from the second refresh rate to the first refresh rate. In some examples, the refresh rate transitions 402A, 402B can occur at same times as the instructions to transition. In examples in which the refresh rate transitions 402A, 402B occur at same times as the instructions to transition, the instruction is received and/or processed at the same time as the refresh rate transition 402A, 402B, and/or immediately before the frame 250A, 200C with the new refresh rate. In this example, the second refresh rate is greater and/or higher than the first refresh rate.

FIG. 4A shows image writing 404A and/or row line scanning during a frame 200A with a first refresh rate, image writing 404B and/or row line scanning during a frame 200B with the first refresh rate, image writing 404C and/or row line scanning during a frame 250A with a second refresh rate, image writing 404D and/or row line scanning during a frame 250B with the second refresh rate, image writing 404E and/or row line scanning during a frame 250C with the second refresh rate, image writing 404F and/or row line scanning during a frame 200C with the first refresh rate, and image writing 404G and/or row line scanning during a frame 200D with the first refresh rate. In the example shown in FIG. 4A, the first refresh rate is lower and/or slower than the second refresh rate, and/or the second refresh rate is higher and/or faster than the first refresh rate.

In the example shown in FIG. 4A, frame times 406A, 406B, 406C, 410A, 410B, 410C, 412A, 412B, 412C, 416A, 416B, 416C which represent times and/or periods between refreshing rows and/or peak signals of pixels in the rows, are the same for all rows when the image writing spans pairs of frames with same refresh rates, such as image writing 404A spanning frames 200A, 200B with the first refresh rate, image writing 404C, spanning frames 250A, 250B with the second refresh rate, image writing 404D spanning frames 250B, 250C with the second refresh rate, and image writing 404F spanning frames 200C, 200D with the first refresh rate. However, the frame times 408A, 408B, 408C, 414A, 414B, 414C that span the refresh rate transitions 402A, 402B, and in which the image writing spans pairs of frames with different refresh rates, such as the image writing 404B spanning frames 200B, 250A and the image writing 404E spanning frames 250C, 200C, are different depending on the row. In the example shown in FIG. 4A, when the refresh rate increases after the refresh rate transition 402A, the frame time 408C for a later-refreshed row and/or a row that is closer to the bottom portion 108 of the display 102 is shorter than the frame time 408A for an earlier-refreshed row and/or a row that is closer to the top portion 106 of the display 102. In the example shown in FIG. 4A, when the refresh rate decreases after the refresh rate transition 402B, the frame time 414C for a later-refreshed row and/or a row that is closer to the bottom portion 108 of the display 102 is longer than the frame time 414A for an earlier-refreshed row and/or a row that is closer to the top portion 106 of the display 102.

Figure 4B:
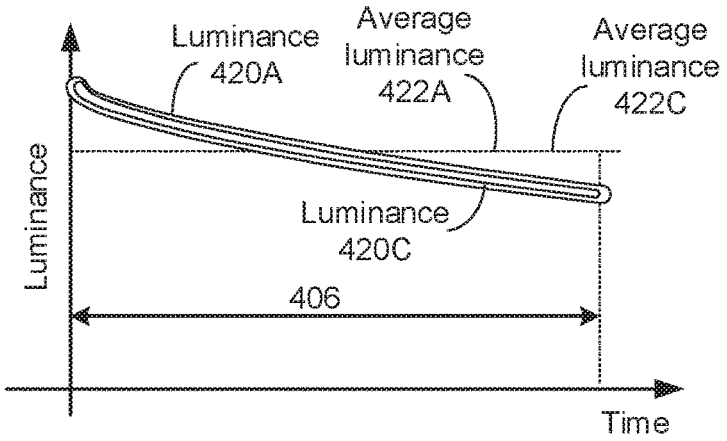
FIG. 4B shows luminance values of rows in frames of FIG. 4A before a refresh rate transition according to an example implementation.

FIG. 4B shows luminance values 420A, 420C of rows in frames 200A 200B of FIG. 4A before the refresh rate transition 402A according to an example implementation. The time variable shown in FIG. 4B is relative to the beginning of writing the image to the respective row. The frame time 406 can represent any of frame times 406A, 406B, 406C shown in FIG. 4A.

As shown in FIG. 4B, with the frame time 406 the same for different pixels and/or rows, the luminance 420C of a row closer to the bottom portion 108 of the display 102 has a same pattern and/or curve as the luminance 420A of a row closer to the top portion 106 of the display 102. The luminance 420C of the row closer to the bottom portion 108 of the display 102 having the same pattern and/or curve as the luminance 420A of the row closer to the top portion 106 of the display 102 causes an average luminance 422C of the row closer to the bottom portion 108 of the display 102 to be the same as and/or equal to the average luminance 422A of the row closer to the top portion 106 of the display 102.

Figure 4C:
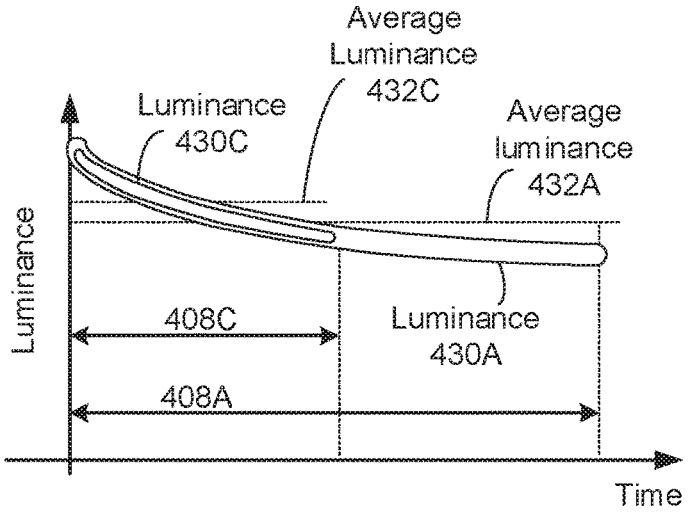
FIG. 4C shows luminance values of rows in frames of FIG. 4A during the refresh rate transition according to an example implementation.

FIG. 4C shows luminance values 430A, 430C of rows in frames 200B, 250A of FIG. 4A during the refresh rate transition 402A according to an example implementation. The time variable shown in FIG. 4C is relative to the beginning of writing the image to the respective row.

As shown in FIG. 4C, with the frame time 408C for the row closer to the bottom portion 108 of the display 102 being shorter than the frame time 408A for the row closer to the top portion 106 of the display 102, the luminance 430C of a row closer to the bottom portion 108 of the display 102 spends less time with lower luminance values before returning to a peak value than the luminance 430A of the row closer to the top portion 108 of the display 102. The luminance 430C of the row closer to the bottom portion 108 of the display 102 spending less time with lower luminance values than the luminance 430A of the row closer to the top portion 106 of the display 102 causes an average luminance 432C of the row closer to the bottom portion 108 of the display 102 to be higher and/or greater than the average luminance 432A of the row closer to the top portion 106 of the display 102.

Figure 4D:
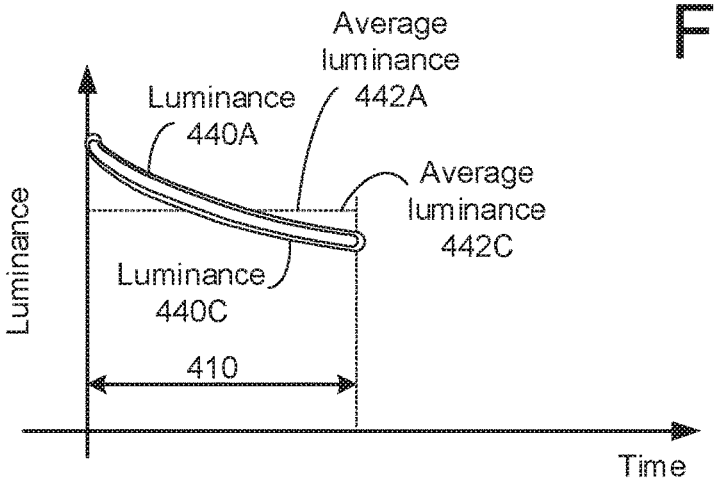
FIG. 4D shows luminance values of rows in frames of FIG. 4A after the refresh rate transition according to an example implementation.

FIG. 4D shows luminance values of rows in frames 250A, 250B of FIG. 4A after the refresh rate transition 402A according to an example implementation. The time variable shown in FIG. 4D is relative to the beginning of writing the image to the respective row. The frame time 410 can represent any of frame times 410A, 410B, 410C shown in FIG. 4A.

As shown in FIG. 4D, with the frame time 414 the same for different pixels and/or rows, the luminance 440C of a row closer to the bottom portion 108 of the display 102 has a same pattern and/or curve as the luminance 440A of a row closer to the top portion 106 of the display 102. The luminance 440C of the row closer to the bottom portion 108 of the display 102 having the same pattern and/or curve as the luminance 440A of the row closer to the top portion 106 of the display 102 causes an average luminance 442C of the row closer to the bottom portion 108 of the display 102 to be the same and/or equal to the average luminance 442A of the row closer to the top portion 106 of the display 102.

Figure 5A:
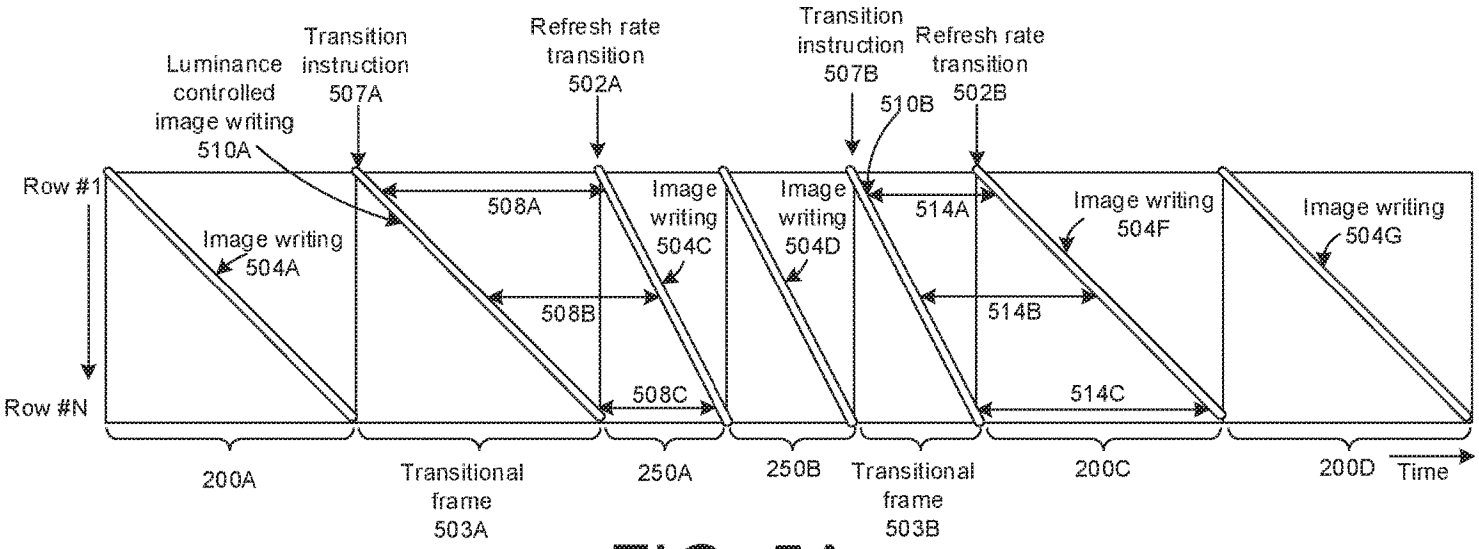
FIG. 5A shows refresh rate transitions and row line scanning with a transitional frame after the refresh rate transition according to an example implementation.

FIG. 5A shows refresh rate transitions 502A, 502B and row line scanning with a transitional frame 503A, 503B before the refresh rate transition 502A, 502B according to an example implementation. The computing device 100 can implement the refresh rate transitions 502A, 502B in response to instructions 507A, 507B to change and/or transition the refresh rate.

Figure 6A:
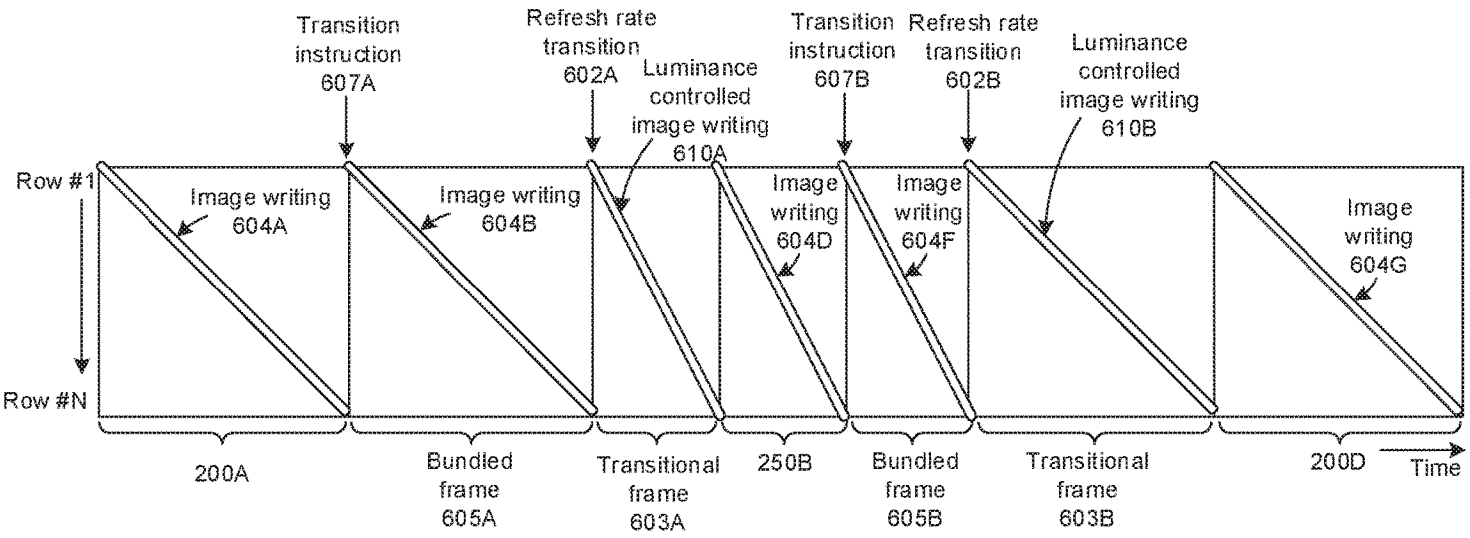
FIG. 6A shows refresh rate transitions and row line scanning with a transitional frame after a refresh rate transition and a bundled frame before the refresh rate transition according to an example implementation.

The transitional frame 503A, 503B, as well as transitional frames 603A, 603B shown and described with respect to FIG. 6A, may be for displaying between a first frame that is subject to the first refresh rate, and a second frame that is subject to the second refresh rate. The frames may be in a sequence, such that the transitional frame is for displaying after the first frame and the second frame may be for displaying after the transitional frame. The computing device 100 may comprise the display 102 for displaying the transitional frame and/or the first frame and/or the second frame. The second row being refreshed after the first row may mean that the second row is refreshed at a later time than the first row.

FIG. 5A shows image writing 504A and/or row line scanning during a frame 200A with a first refresh rate, controlled luminance image writing 510A and/or row line scanning during a transitional frame 503A with the first refresh rate, image writing 504C and/or row line scanning during a frame 250A with a second refresh rate, image writing 504D and/or row line scanning during a frame 250B with the second refresh rate, controlled luminance image writing 510B and/or row line scanning during a transitional frame 503B with the second refresh rate, image writing 504F and/or row line scanning during a frame 200C with the first refresh rate, and image writing 504G and/or row line scanning during a frame 200D with the first refresh rate. In the example shown in FIG. 5A, the first refresh rate is lower and/or slower than the second refresh rate, and/or the second refresh rate is higher and/or faster than the first refresh rate.

In some examples, after a refresh rate transition instruction 507A from a first refresh rate to a second refresh rate, the computing device 100 generates a transitional frame 503A before a refresh rate transition 502A from the first refresh rate to the second refresh rate. In some examples, after a refresh rate transition instruction 507B from the second refresh rate to the first refresh rate, the computing device 100 generates a transitional frame 503B before a refresh rate transition 502B from the second refresh rate to the first refresh rate. Similar to the frame times 408A, 408B, 408C, 414A, 414B, 414C, frame times 508A, 508B, 508C, 514A, 514B, 514C spanning the refresh rate transitions 502A, 502B have different lengths, time periods, and/or time durations based on the location of the row on the display 102. Rows that are higher on the display 102, and/or are refreshed first, have longer time durations than rows that are lower on the display 102 and/or are refreshed later when the refresh rate increases, as shown by the decreasing lengths of frame times 508A, 508B, 508C. Rows that are higher on the display 102, and/or are refreshed first, have shorter time durations than rows that are lower on the display 102 and/or are refreshed later when the refresh rate decreases, as shown by the increasing lengths of frame times 514A, 514B, 514C. In some examples, the frame times 508A, 514A can represent frame times of a first row of pixels on the display 102, frame times 508B, 514B can represent frame times of a second row of pixels on the display 102, and frame times 508C, 514C can represent frame times of a third row of pixels on the display 102. A distance between the second row and the top portion 106 of the display 102 can be greater than a distance between the first row and the top portion 106 of the display 102. A distance between the third row and the top portion 106 of the display 102 can be greater than the distance between the first row and the top portion 106 of the display 102, and can be greater than the distance between the second row and the top portion 106 of the display 102.

To maintain same luminance values while the frame times are changing and avoid an appearance of flickering, the computing device 100 can adjust peak signals and/or peak luminances of pixels in the rows. The computing device 100 can adjust the peak signals and/or peak luminances by reducing the intensity of peak signals in rows that have shorter time durations, and/or increase the intensity of peak signals that have longer time durations.

Figure 5B:
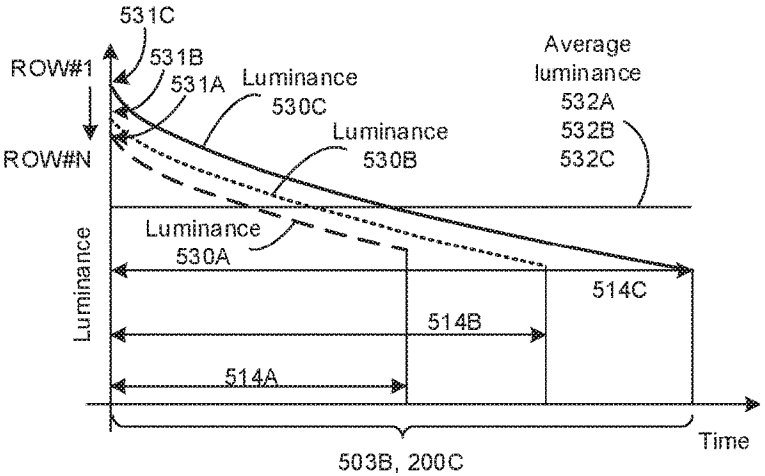
FIG. 5B shows luminance values of rows in frames of FIG. 5A spanning a transition to a higher refresh rate according to an example implementation.

FIG. 5B shows luminance values 520A, 520B, 520C of rows in frames 503A, 250A of FIG. 5A spanning a transition 502A to a higher refresh rate according to an example implementation. The time is relative to the beginning of the luminance controlled image writing 510A for the respective row, rather than absolute times. In some examples, the luminance value 520A can span the frame time 508A during transitional frame 503A, luminance value 520B can span the frame time 508B during the transitional frame 503A and frame 250A, and/or luminance value 520C can span the frame time 508C during frame 250A. As shown in FIG. 5B, the lower-most and/or bottommost row has a shorter frame time 508C than the frame times frames 508B, 508A of the middle row or topmost row before being refreshed again, and the middle row has a shorter time frame 508B than the time frame 508A of the topmost row before being refreshed again. The shorter frame time 508C of the lower-most and/or bottommost row causes a luminance 520C of the lower-most and/or bottommost row to stop decreasing and/or to refresh sooner relative to the beginning of the peak signal 521C than the luminances 520B, 520A of the middle and topmost rows.

To compensate for the different frame times 508A, 508B, 508C, the topmost row with the longest frame time 508A has a highest peak luminance 521A, the middle row with the middle frame time 508B has a middle peak luminance 521B, and the lower-most and/or bottommost row with the shortest frame time 508C has the lowest peak luminance 521C. The peak luminance 521A of the topmost and/or first-refreshed row can be considered to have been adjusted upward and/or increased, and/or the peak luminance 521C of the lower-most and/or bottommost and/or last-refreshed row can be considered to have been adjusted downward and/or decreased. In this example, the second refresh rate is greater than the first refresh rate, and the adjustments of the peak luminances 521B, 521C are negative values. The different peak luminances 521A, 521B, 521C, in combination with the different frame times 508A, 508B, 508C, can cause the rows to have same and/or equal average luminances 522A, 522B, 522C.

Figure 5C:
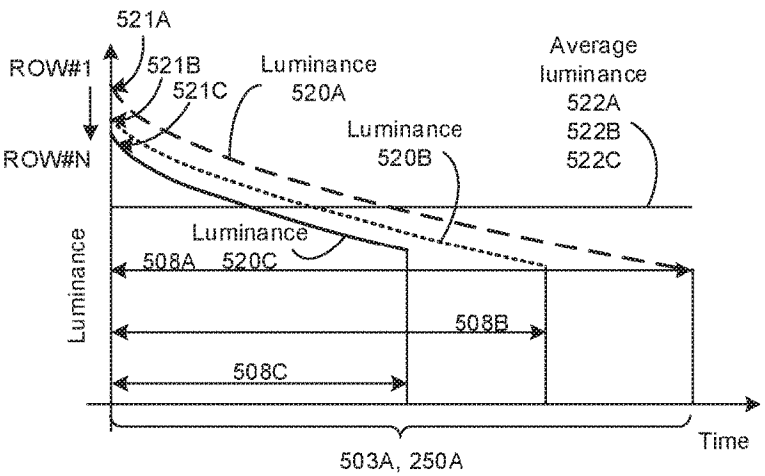
FIG. 5C shows luminance values of rows in frames of FIG. 5A spanning a transition to a lower refresh rate according to an example implementation.

FIG. 5C shows luminance values 530A, 530B, 530C of rows in frames 503B, 200C of FIG. 5A spanning a transition 502B to a lower refresh rate according to an example implementation. The time is relative to the beginning of the luminance controlled image writing 510B for the respective row, rather than absolute times. As shown in FIG. 5C, the lower-most and/or bottommost row has a longer frame time 514C than the frame times 514B, 514A of the middle row or topmost row before being refreshed again, and the middle row has a longer frame time 514B than the frame time 514A of the topmost row before being refreshed again. The longer frame time 514C of the lower-most and/or bottommost row causes a luminance 530C of the lower-most and/or bottommost row to stop decreasing and/or to refresh later relative to the beginning of the peak signal 531C than the luminances 530B, 530A of the middle and topmost rows.

To compensate for the different frame times 514A, 514B, 514C, the topmost row with the shortest frame time 514A has a lowest peak luminance 531A, the middle row with the middle frame time 514B has a middle peak luminance 531B, and the lower-most and/or bottommost row with the longest frame time 514C has the lowest peak luminance 531C. The peak luminance 531A of the topmost and/or first-refreshed row can be considered to have been adjusted downward and/or decreased, and/or the peak luminance 531C of the most and/or last-refreshed row can be considered to have been adjusted upward and/or increased. In this example, the second refresh rate is lower than the first refresh rate, and the adjustments of the peak luminances 531B, 531C are positive values. The different peak luminances 531A, 531B, 531C, in combination with the different frame times 514A, 514B, 514C, can cause the rows to have same average luminances 532A, 532B, 532C.

In some examples, the computing device 100 can predict an average luminance that pixels in each row would have if the first refresh rate had been maintained, and/or the refresh rate had not transitioned, and the peak signal and/or peak luminance 521A, 521B, 521C, 531A, 531B, 531C had not been adjusted. The computing device 100 can determine how much an average luminance in each row will change based on the transition from the first refresh rate to the second refresh rate. Based on the determination of how much the average luminance will change based on the transition from the first refresh rate to the second refresh rate, the computing device 100 can determine an adjustment to a peak signal and/or peak luminance 521A, 521B, 521C, 531A, 531B, 531C for each row and/or pixel that will cause the average luminance 522A, 522B, 522C, 532A, 532B, 532C to be the same, after the refresh rate transition 502A, 502B, as the predicted average luminance if the first refresh rate had been maintained and/or not transitioned.

FIG. 6A shows refresh rate transitions 602A, 602B and row line scanning with a transitional frame 603A, 603B after a refresh rate transition 602A, 602B and a bundled frame 605A, 605B before the refresh rate transition 602A, 602B according to an example implementation. The frames may be for displaying in the following temporal order: a first frame such as frame 200A or frame 250B, the bundled frame 605A, 605B, the transitional frame 603A, 603B and a second frame such as frame 250B (when frame 200A is the first frame) or frame 200D (when frame 250B is the first frame).

The bundled frames 605A, 605B can immediately precede their respective transitional frames 603A, 603B. The computing device 100 can generate the bundled frames 605A, 605B after receiving transition instructions 607A, 607B instructing the computing device 100 and/or display 102 to transition from the first refresh rate to the second refresh rate and back from the second refresh rate to the first refresh rate. In this example, the computing device 100 can maintain a same peak signal 621A, 621B and/or peak luminance for all rows during the bundled frame 605A, and adjust a peak signal 631A, 631B and/or peak luminance for rows based on the row location and/or time of refreshing the rows during the transitional frame 603A. The adjustment of the peak luminance 631A, 631B during the transitional frame 603A can cause the two-frame average luminance of the bottommost rows, which is an average of the bundled frame 605A average luminance 622B, and the transitional frame 603A average luminance 632B, to be the same as and/or equal to the two-frame average luminance of the topmost rows, which is an average of the bundled frame 605A average luminance 622A and the transitional frame 603A average luminance 632A.

Figure 6B:
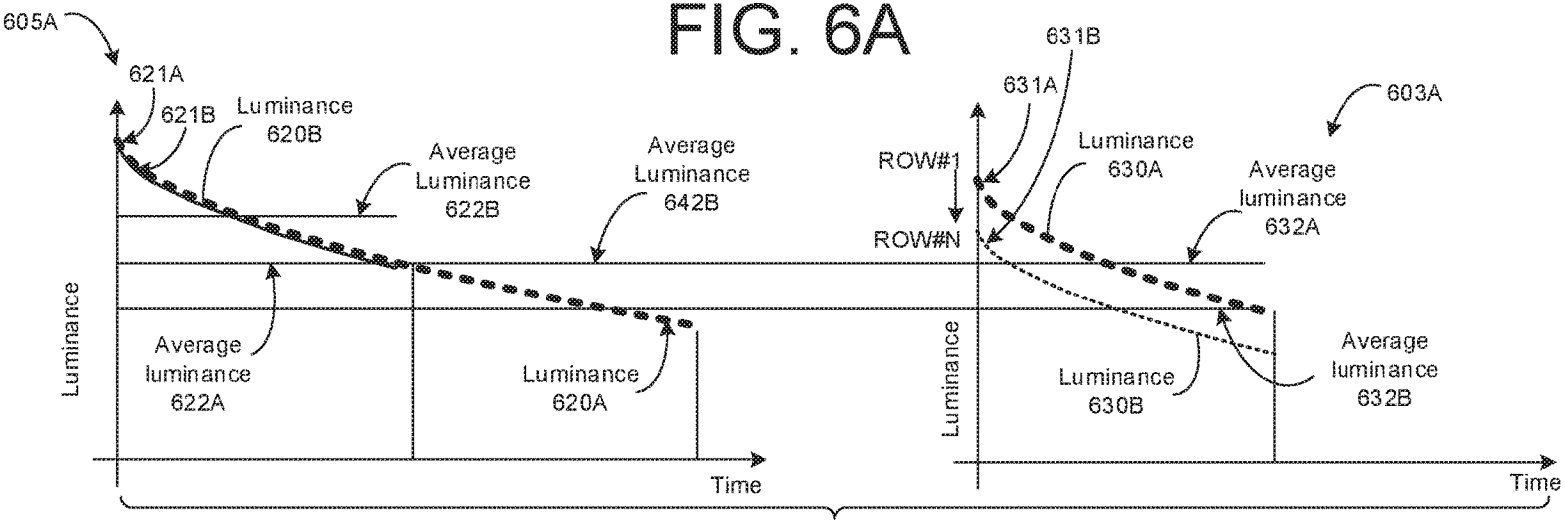
FIG. 6B shows luminance values of rows in frames of FIG. 6A during and after the bundled frame and transitional frame of FIG. 6A according to an example implementation.

FIG. 6B shows luminance values 620A, 620B, 630A, 630B of rows in frames 605A, 603A of FIG. 6A during and after the bundled frame 605A and transitional frame 603A of FIG. 6A according to an example implementation. The time is relative to peak luminances 621A, 621B, 631A, 631B and/or beginning of the refreshes caused by the image writing 604B and luminance controlled image writing 610A for each row. In the example shown in FIG. 6B, during the bundled frame 605A, the rows have same peak luminances 621A, 621B during the image writing 604B. The luminance 620B of the lower row and/or later-refreshed row stops decreasing and/or is refreshed sooner than the luminance 620A of the higher row and/or earlier-refreshed row, causing an average luminance 622B of the lower row and/or later-refreshed row from the image writing 604B to be higher and/or greater than an average luminance 622A of the higher row and/or sooner-refreshed row from the image writing 604B.

During the transitional frame 603A, the luminance controlled image writing 610A is adjusted to lower the peak luminance 631B of the lower row and/or later-refreshed row, causing an average luminance 632B of the lower row and/or later-refreshed row from the luminance-controlled image writing 610A during the transitional frame 603A to be lower than an average luminance 630A of the higher row and/or earlier-refreshed row from the luminance-controlled image writing 610A during the transitional frame 603A. The adjustment to lower the peak luminance 631B of the lower row and/or later-refreshed row can cause the two-frame average luminance 642B of the lower row and/or later-refreshed row to be the same as and/or equal to the average luminance 622A of the higher row and/or sooner-refreshed row from the image writing 604B during the bundled frame 605A and the average luminance 632A of the higher row and/or sooner-refreshed row from the luminance-controlled image writing 610A during the transitional frame 603A. In some examples, the computing device 100 can raise a peak signal of the lower row and/or later-refreshed row from the luminance-controlled image writing 610B during the transitional frame 603B to cause an average luminance of the lower row and/or later-refreshed row from the image writing 604F during the bundled frame 605B and the luminance-controlled image writing 610B during the transitional frame 603B to be the same as and/or equal to the average luminance of the higher row and/or earlier-refreshed row from the image writing 604F during the bundled frame 605B and the same as and/or equal to the average luminance of the higher row and/or earlier-refreshed row from the luminance-controlled image writing 610B during the transitional frame 603B.

The average luminance and/or predicted average luminance may be an average taken across the transitional frame 605A, 605B and the bundled frame 603A, 603B. The average luminance 642B and/or predicted average luminance may be an average taken across the time period between the at least one pixel in the second row receiving the peak signal in the bundled frame and the at least one pixel in the second row receiving the adjusted peak signal in the transitional frame.

Figure 7A:
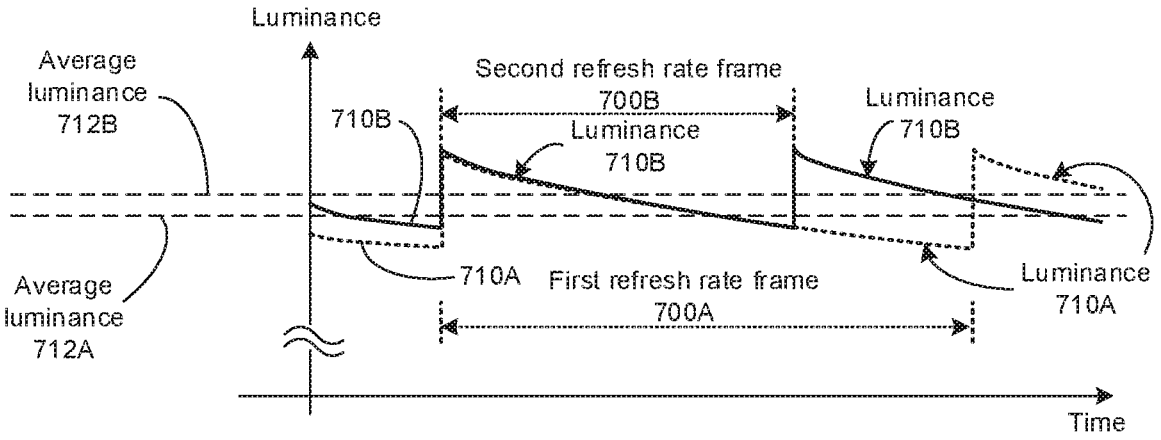
FIG. 7A shows luminance values of rows for two refresh rates at a relatively high encoded intensity.

FIG. 7A shows luminance values 710A, 710B of rows for two refresh rates at a relatively high encoded intensity. The change in luminance values for pixels after the refresh and/or peak luminance can depend on the encoded intensity. When pixels have relatively high encoded intensity, the luminance 710A, 710B decreases after the refresh and/or peak luminance, causing an average luminance 712B of pixels and/or rows with higher refresh rates and/or shorter refresh rate frames 700B to have higher than an average luminance 712A of pixels and/or rows with lower refresh rates and/or longer refresh rate frames 700A. In some examples, when a second and/or later refresh rate is greater than a first refresh rate, and an encoded intensity of at least one pixel in a second row (which is farther from the top portion 106 of the display 102 than the first row) is within a high luminance range, an adjustment to the peak signal and/or peak luminance of the pixels in the second row can be a negative value. In some examples, the high luminance range can include luminance values at or above a high luminance threshold value, such as within twenty-five percent of a maximum luminance and/or encoded intensity.

An encoded intensity level can be based on pixel values sent, outputted, and/or provided to the display 102, such as red, green, and blue values in an RGB color model. An example of an encoded intensity level can be a gray level. The gray level can be an average value of the color components, such as red, green, and blue, for a pixel in the RGB color model, or a weighted average, such as 0.299 times the red value, plus 0.587 times the green value, plus 0.114 times the blue value in the RGB color model. In the YCbCr color model, the gray value can be the Y or luma component.

Figure 7B:
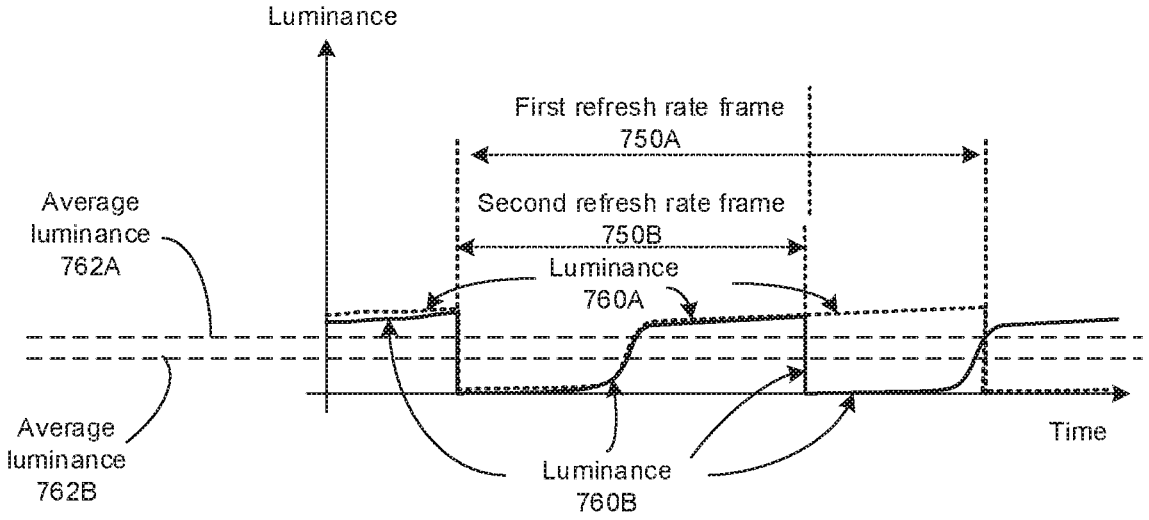
FIG. 7B shows luminance values of rows for two refresh rates at a relatively low encoded intensity.

FIG. 7B shows luminance values of rows for two refresh rates at a relatively low encoded intensity. When pixels have relatively low encoded intensity, the luminance 760A, 760B increases after the refresh, causing the average luminances 762B of pixels and/or rows with higher refresh rates and/or shorter refresh rate frames 750B to be lower than an average luminance 762A of pixels and/or rows with lower refresh rates and/or longer refresh rate frames 750A. For rows and/or pixels with lower encoded intensity, the computing device 100 can raise and/or increase the peak signal value of rows with shorter frame times. For rows and/or pixels with higher encoded intensity, the computing device 100 can lower the peak signal values of rows with shorter frame times. In some examples, when a second and/or later refresh rate is greater than a first refresh rate, and an encoded intensity of at least one pixel in a second row (which is farther from the top portion 106 of the display 102 than the first row) is within a low luminance range, an adjustment to the peak signal and/or peak luminance of the pixels in the second row can be a positive value. A low luminance range can include luminance values at or a below a low luminance threshold, such as within twenty-five percent of a lowest luminance level and/or a lowest encoded intensity. In some examples, when the second refresh rate is greater than the first refresh rate, and the encoded intensity of at least one pixel in the second row is within a medium luminance range, an adjustment to the peak signal and/or peak luminance of the pixels in the second row can be zero. A medium luminance range can include luminance values above a low luminance threshold (such as within twenty-five percent of a minimum luminance and/or encoded intensity) and below a high luminance threshold (such as within twenty-five percent of a maximum luminance and/or encoded intensity).

Figure 8:
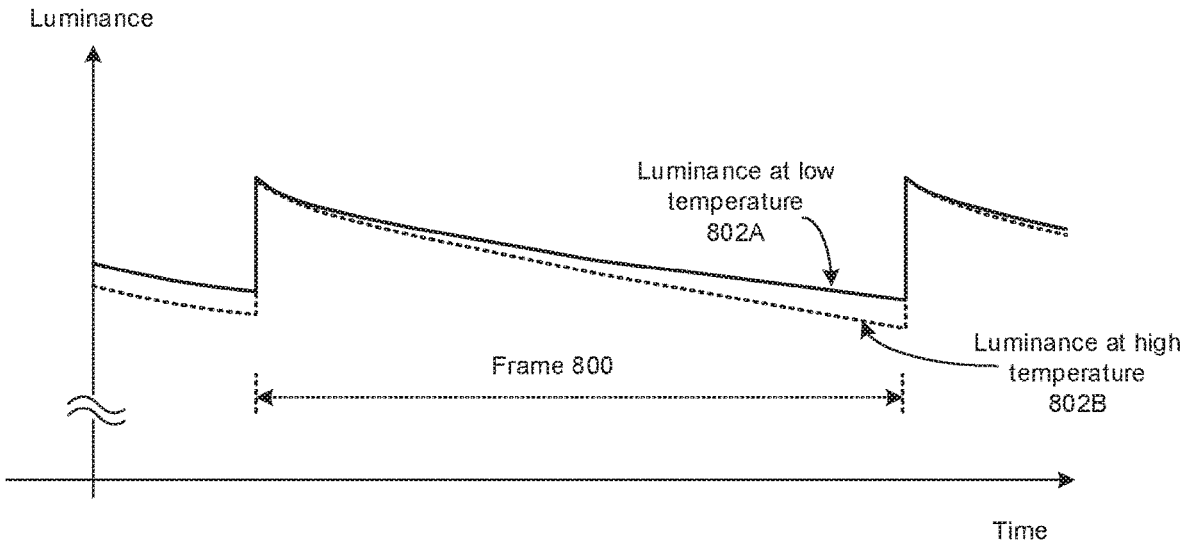
FIG. 8 shows luminance values of pixels at two different temperatures.

FIG. 8 shows luminance values 802A, 802B of pixels at two different temperatures. Luminance 802A, 802B can decline faster at high temperatures than at low temperatures. Based on the faster declining luminance 802A, 802B at high temperatures, the computing device 100 can adjust the peak signal by a greater absolute value at high temperatures than at low temperatures. The computing device 100 can, for example, measure a temperature of the display 102 and adjust the peak signal and/or luminance of pixels based on the row in which the pixels are included and the measured temperature of the display 102.

Figure 9:
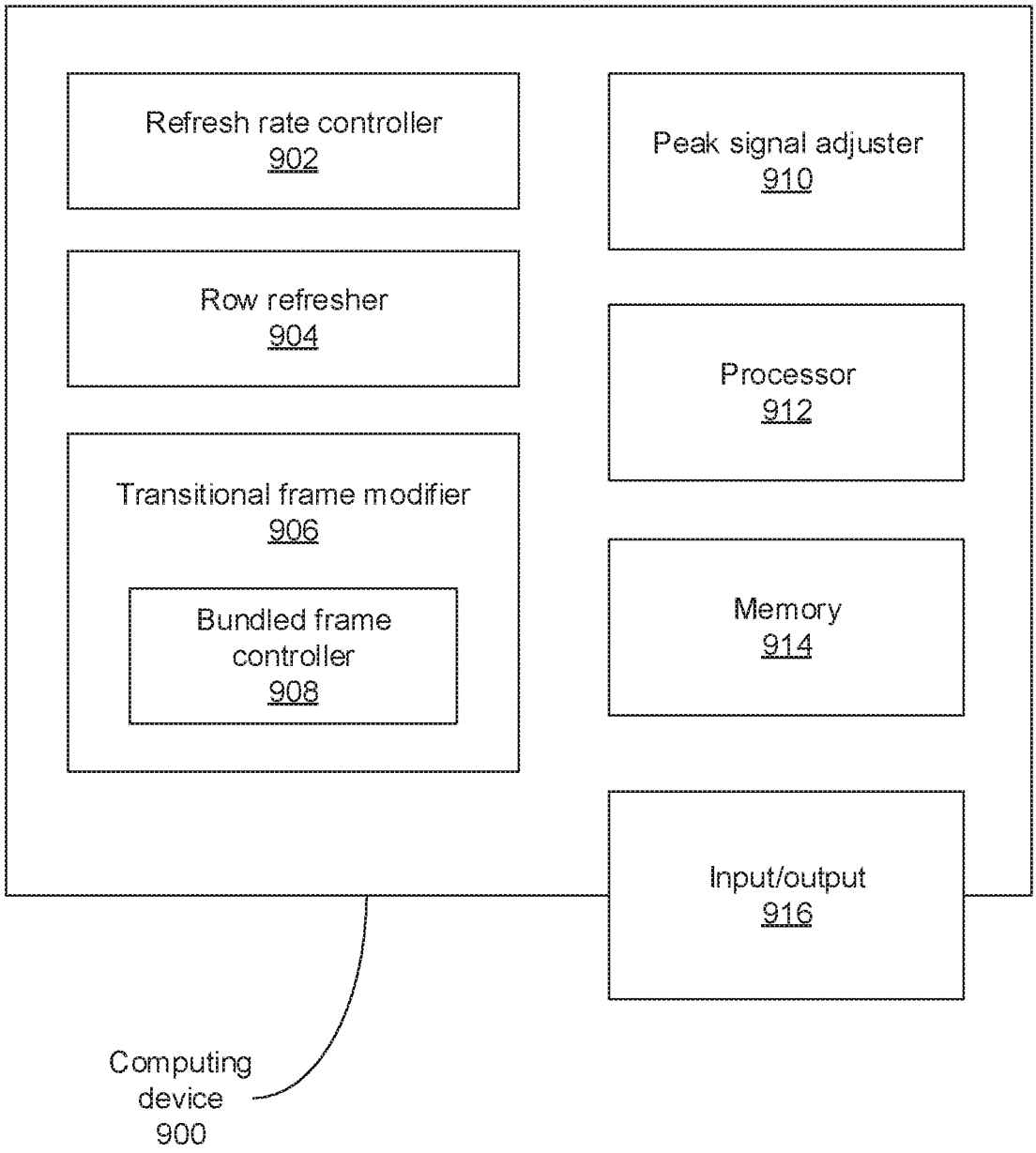
FIG. 9 is a block diagram of a computing device.

FIG. 9 is a block diagram of a computing device 900. The computing device 900 can be an example of the computing device 100 and can have any combination of features and/or functionalities of the computing device 100 described herein.

The computing device 900 can include a refresh rate controller 902. The refresh rate controller 902 can control a refresh rate of a display, such as the display 102. In some examples, the refresh rate controller 902 can control the refresh rate of the display based on a type of application running on the computing device 900. In some examples, the refresh rate controller 902 can cause the display to have a relatively high refresh rate, such as ninety Hertz or one hundred and twenty Hertz, when a more graphic-intensive application is running on the computing device 900. In some examples, the refresh rate controller 902 can cause the display to have a relatively low refresh rate, such as thirty Hertz or sixty Hertz, when a less graphic-intensive application is running on the computing device 900. Examples of more graphic-intensive applications include video games and video applications. Examples of less graphic-intensive applications include web browsers, word processing applications, spreadsheet applications, or electronic messaging applications. The refresh rate controller 902 can cause the refresh rate to transition, and/or generate a transition instruction, from a first refresh rate to a second refresh rate in response to the computing system 900 changing from running a less graphic-intensive application to running a more graphic-intensive application. The refresh rate controller 902 can cause the refresh rate to transition, and/or generate a transition instruction, from the second refresh rate to the first refresh rate in response to the computing system 900 changing from running the more graphic-intensive application to running the less graphic-intensive application.

The computing device 900 can include a row refresher 904. The row refresher 904 can refresh rows of pixels included in a display of the computing device 900, such as the display 102. The row refresher 904 can refresh the rows by providing inputs and/or signals to the pixels in the rows. The inputs and/or signals can cause the pixels to achieve peak luminances, such as the peak luminances 521A, 521B, 521C, 531A, 531B, 531C, 621A, 621B, 631A, 631B shown in FIGS. 5B, 5C, and 6B.

The computing device 900 can include a transitional frame modifier 906. The transitional frame modifier 906 can modify signals, such as peak signals, that the row refresher 904 provides, outputs, and/or sends to pixels in rows. In some examples, the transitional frame modifier 906 can instruct a peak signal adjuster 910 to adjust the peak signals and/or peak luminances 521A, 521B, 521C, 531A, 531B, 531C, 621A, 621B, 631A, 631B of rows. The transitional frame modifier 906 can modify the signals in response to the refresh rate controller 902 changing a refresh rate.

The transitional frame modifier 906 can perform different modifications on different rows. In some examples, the transitional frame modifier 906 can refresh a first row in a display with a first adjustment to a peak signal of at least one pixel in the first row, and refresh a second row in the display with a second adjustment to a peak signal of at least one pixel in the second row. The second row can be lower in the display than the first row and/or can be refreshed after the second row. The second adjustment can be greater than the first adjustment.

In some examples, the transitional frame modified by the transitional frame modifier 906 can include a last frame, such as either of the transitional frames 503A, 503B shown in FIG. 5A, displayed at the first refresh rate before transitioning from the first refresh rate to the second refresh rate.

In some examples, the transitional frame modified by the transitional frame modifier 906 can include a first frame, such as either of the transitional frames 603A, 603B shown in FIG. 6A, displayed at the second refresh rate after transitioning from the first refresh rate to the second refresh rate.

The transitional frame modifier 906 can include a bundled frame controller 908. The bundled frame controller 908 can cause the computing device 100 to generate and/or display a bundled frame, such as either of the bundled frames 605A, 605B. The computing device 100 can generate and/or display the bundled frame at the first refresh rate after receiving the instruction to transition from the first refresh rate to the second refresh rate and before generating and/or displaying the transitional frame 603A, 603B.

The computing device 900 can include a peak signal adjuster 910. The computing device 900 can adjust signals sent to pixels within rows that generate peak luminances 521A, 521B, 521C, 531A, 531B, 531C, 621A, 621B, 631A, 631B based on a refresh rate transition, row number, encoded intensity of a color to be displayed by the pixel, and/or a temperature of the pixel and/or row.

The computing device 900 can include at least one processor 912. The at least one processor 912 can execute instructions, such as instructions stored in at least one memory device 914, to cause the computing device 900 to perform any combination of methods, functions, and/or techniques described herein, such as controlling an image presented by a display such as the 102 and/or a luminance of the image presented by the display.

The computing device 900 can include at least one memory device 914. The at least one memory device 914 can include a non-transitory computer-readable storage medium. The at least one memory device 914 can store data and instructions thereon that, when executed by at least one processor, such as the processor 912, are configured to cause the computing device 900 to perform any combination of methods, functions, and/or techniques described herein. Accordingly, in any of the implementations described herein (even if not explicitly noted in connection with a particular implementation), software (e.g., processing modules, stored instructions) and/or hardware (e.g., processor, memory devices, etc.) associated with, or included in, the computing device 900 can be configured to perform, alone, or in combination with the computing device 900, any combination of methods, functions, and/or techniques described herein.

The computing device 900 may include at least one input/output node 916. The at least one input/output node 916 may receive and/or send data, such as from and/or to, a server, and/or may receive input and provide output from and to a user. The input and output functions may be combined into a single node, or may be divided into separate input and output nodes. The input/output node 916 can include, for example, a display such as the display 102, a camera, a speaker, a microphone, one or more buttons, and/or one or more wired or wireless interfaces for communicating with other computing devices.

Figure 10:
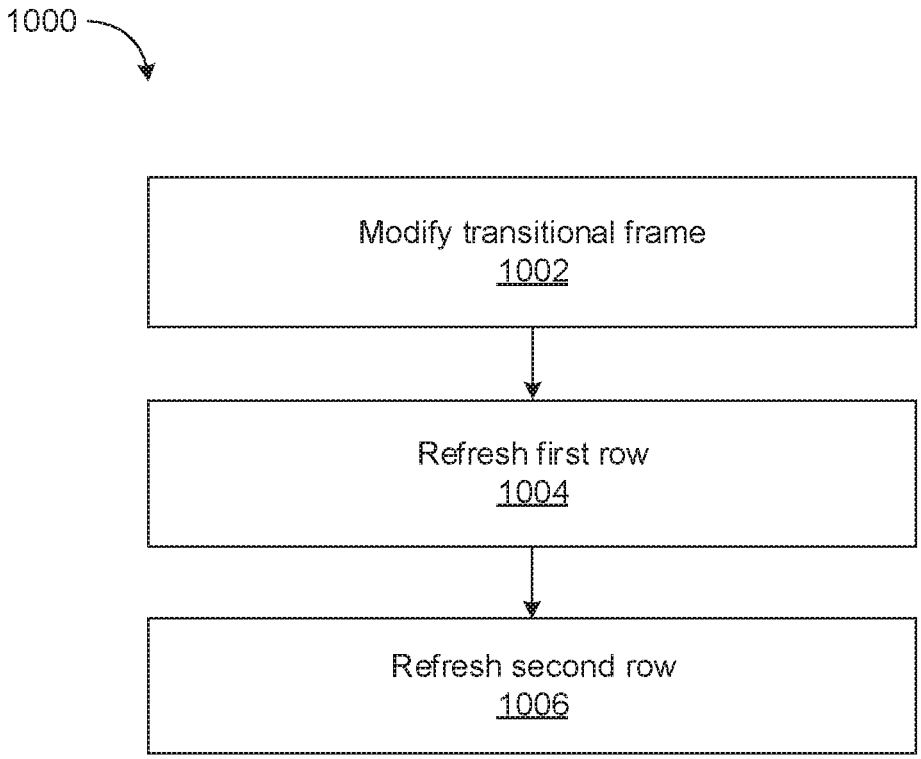
FIG. 10 is a flowchart showing a method according to an example implementation.

FIG. 10 is a flowchart showing a method 1000 according to an example implementation. The method can include modifying a transitional frame 503A, 503B, 603A, 603B (1002). The modifying the transitional frame (1002) can include, in response to an instruction 507A, 507B, 607A, 607B to transition from a first refresh rate to a second refresh rate, modifying the transitional frame 503A, 503B, 603A, 603B. The modifying the transitional frame (1002) can include refreshing a first row (1004) and refreshing a second row (1006). Refreshing the first row (1004) can include refreshing the first row in a display 102 with a first adjustment to a peak signal of at least one pixel in the first row. Refreshing the second row (1006) can include refreshing the second row in the display 102 with a second adjustment to a peak signal of at least one pixel in the second row, the second row being refreshed after the first row, the second adjustment being greater than the first adjustment.

In some examples, the transitional frame can include a last frame displayed at the first refresh rate before transitioning from the first refresh rate to the second refresh rate.

In some examples, the adjustment to the peak signal of the at least one pixel in the second row can cause an average luminance of the at least one pixel in the second row to be equal to a predicted average luminance that the at least one pixel in the second row would have had if the first refresh rate had been maintained and the peak signal of the at least one pixel in the second row had not been adjusted.

In some examples, the transitional frame can include a first frame displayed at the second refresh rate after transitioning from the first refresh rate to the second refresh rate.

In some examples, the instructions are further configured to cause the computing device to display a bundled frame after receiving the instruction to transition from the first refresh rate to the second refresh rate. The bundled frame can have the first refresh rate and can immediately precede the transitional frame.

In some examples, the adjustment to the peak signal of the at least one pixel in the second row can cause an average luminance of the at least one pixel in the second row during the transitional frame and the bundled frame to be equal to a predicted average luminance that the at least one pixel in the second row would have had if the first refresh rate had been maintained and the peak signal of the at least one pixel in the second row had not been adjusted.

In some examples, a distance between the second row and a top portion of the display can be greater than a distance between the first row and the top portion of the display.

In some examples, the first adjustment can be zero, and the modifying the transitional frame can further include refreshing a third row in the display with a third adjustment to a peak signal of at least one pixel in the third row. The third row can be refreshed after the second row. The third adjustment can be greater than the second adjustment.

In some examples, a sign of the second adjustment can be based on an encoded intensity of the at least one pixel in the second row.

In some examples, the second adjustment can be based on a location in the display of the second row and an encoded intensity of the at least one pixel in the second row.

In some examples, the second adjustment can be based on a location in the display of the second row, an encoded intensity of the at least one pixel in the second row, and a measured temperature of the display.

In some examples, the second adjustment can be based on a location in the display of the second row and a measured temperature of the display.

In some examples, the second refresh rate can be greater than the first refresh rate, and the second adjustment can be a negative value.

In some examples, the second refresh rate can be greater than the first refresh rate, an encoded intensity of the at least one pixel in the second row can be within a high luminance range, and/or the second adjustment can be a negative value.

In some examples, the second refresh rate can be greater than the first refresh rate, an encoded intensity of the at least one pixel in the second row can be within a low luminance range, and/or the second adjustment can be a positive value.

In some examples, an encoded intensity of the at least one pixel in the second row can be within a medium luminance range, and the second adjustment can be zero.

Figure 11:
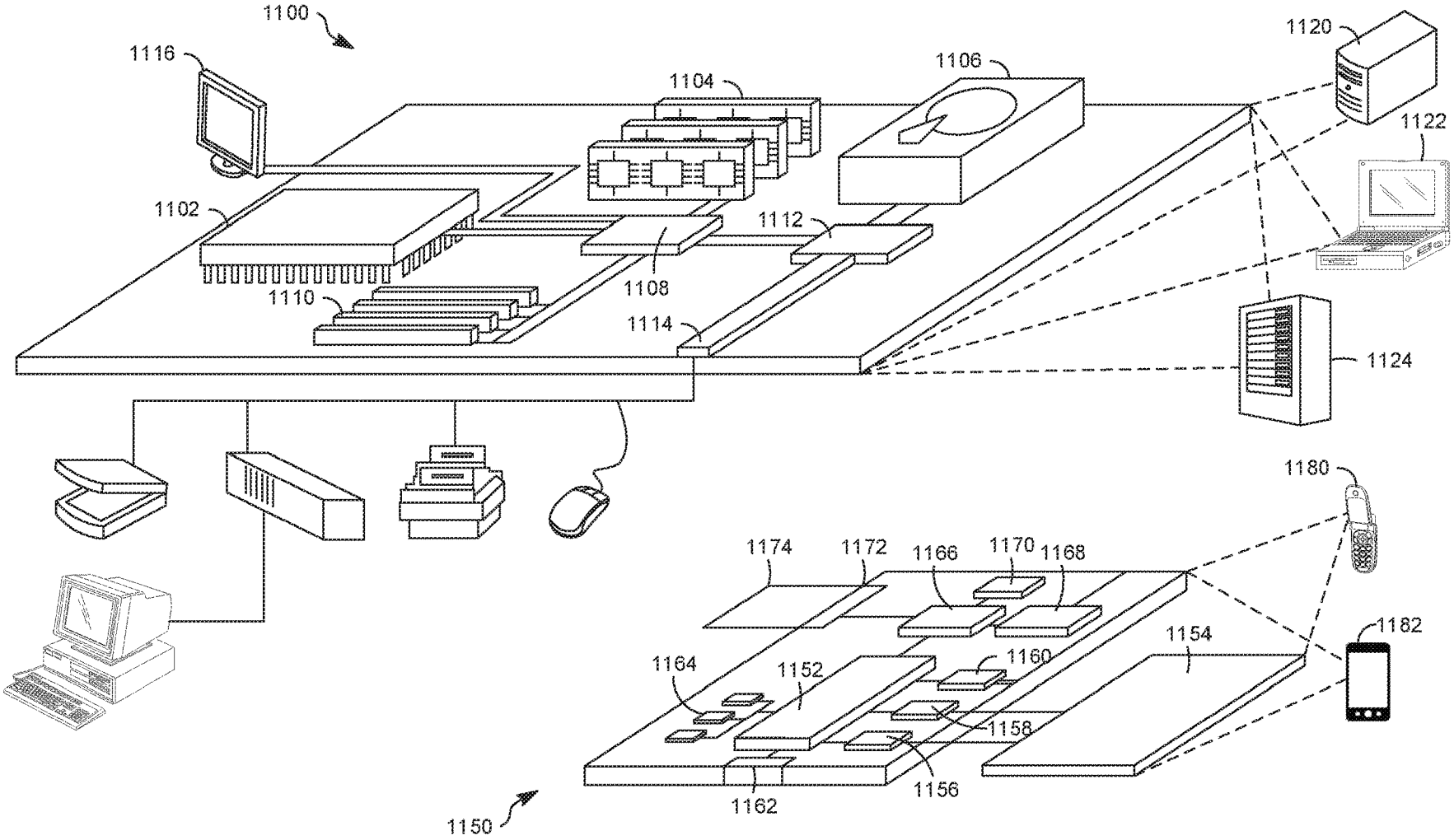
FIG. 11 shows an example of a computer device and a mobile computer device that can be used to implement the techniques described here.

FIG. 11 shows an example of a generic computer device 1100 and a generic mobile computer device 1150, which may be used with the techniques described here. Computing device 1100 is intended to represent various forms of digital computers, such as laptops, desktops, tablets, workstations, personal digital assistants, televisions, servers, blade servers, mainframes, and other appropriate computing devices, and can be an example of either computing device 100, 900. Computing device 1150 is intended to represent various forms of mobile devices, such as personal digital assistants, cellular telephones, smart phones, and other similar computing devices, and can be an example of either computing device 100, 900. The components shown here, their connections and relationships, and their functions, are meant to be exemplary only, and are not meant to limit implementations of the inventions described and/or claimed in this document.

Computing device 1100 includes a processor 1102, memory 1104, a storage device 1106, a high-speed interface 1108 connecting to memory 1104 and high-speed expansion ports 1110, and a low speed interface 1112 connecting to low speed bus 1114 and storage device 1106. The processor 1102 can be a semiconductor-based processor. The memory 1104 can be a semiconductor-based memory. Each of the components 1102, 1104, 1106, 1108, 1110, and 1112, are interconnected using various busses, and may be mounted on a common motherboard or in other manners as appropriate. The processor 1102 can process instructions for execution within the computing device 1100, including instructions stored in the memory 1104 or on the storage device 1106 to display graphical information for a GUI on an external input/output device, such as display 1116 coupled to high speed interface 1108. In other implementations, multiple processors and/or multiple buses may be used, as appropriate, along with multiple memories and types of memory. Also, multiple computing devices 1100 may be connected, with each device providing portions of the necessary operations (e.g., as a server bank, a group of blade servers, or a multi-processor system).

The memory 1104 stores information within the computing device 1100. In one implementation, the memory 1104 is a volatile memory unit or units. In another implementation, the memory 1104 is a non-volatile memory unit or units. The memory 1104 may also be another form of computer-readable medium, such as a magnetic or optical disk.

The storage device 1106 is capable of providing mass storage for the computing device 1100. In one implementation, the storage device 1106 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 1104, the storage device 1106, or memory on processor 1102.

The high speed controller 1108 manages bandwidth-intensive operations for the computing device 1100, while the low speed controller 1112 manages lower bandwidth-intensive operations. Such allocation of functions is exemplary only. In one implementation, the high-speed controller 1108 is coupled to memory 1104, display 1116 (e.g., through a graphics processor or accelerator), and to high-speed expansion ports 1110, which may accept various expansion cards (not shown). In the implementation, low-speed controller 1112 is coupled to storage device 1106 and low-speed expansion port 1114. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 1100 may be implemented in a number of different forms, as shown in the figure. For example, it may be implemented as a standard server 1120, or multiple times in a group of such servers. It may also be implemented as part of a rack server system 1124. In addition, it may be implemented in a personal computer such as a laptop computer 1122. Alternatively, components from computing device 1100 may be combined with other components in a mobile device (not shown), such as device 1150. Each of such devices may contain one or more of computing device 1100, 1150, and an entire system may be made up of multiple computing devices 1100, 1150 communicating with each other.

Computing device 1150 includes a processor 1152, memory 1164, an input/output device such as a display 1154, a communication interface 1166, and a transceiver 1168, among other components. The device 1150 may also be provided with a storage device, such as a microdrive or other device, to provide additional storage. Each of the components 1150, 1152, 1164, 1154, 1166, and 1168, are interconnected using various buses, and several of the components may be mounted on a common motherboard or in other manners as appropriate.

The processor 1152 can execute instructions within the computing device 1150, including instructions stored in the memory 1164. The processor may be implemented as a chipset of chips that include separate and multiple analog and digital processors. The processor may provide, for example, for coordination of the other components of the device 1150, such as control of user interfaces, applications run by device 1150, and wireless communication by device 1150.

Processor 1152 may communicate with a user through control interface 1158 and display interface 1156 coupled to a display 1154. The display 1154 may be, for example, a TFT LCD (Thin-Film-Transistor Liquid Crystal Display) or an OLED (Organic Light Emitting Diode) display, or other appropriate display technology. The display interface 1156 may comprise appropriate circuitry for driving the display 1154 to present graphical and other information to a user. The control interface 1158 may receive commands from a user and convert them for submission to the processor 1152. In addition, an external interface 1162 may be provided in communication with processor 1152, so as to enable near area communication of device 1150 with other devices. External interface 1162 may provide, for example, for wired communication in some implementations, or for wireless communication in other implementations, and multiple interfaces may also be used.

The memory 1164 stores information within the computing device 1150. The memory 1164 can be implemented as one or more of a computer-readable medium or media, a volatile memory unit or units, or a non-volatile memory unit or units. Expansion memory 1174 may also be provided and connected to device 1150 through expansion interface 1172, which may include, for example, a SIMM (Single In Line Memory Module) card interface. Such expansion memory 1174 may provide extra storage space for device 1150, or may also store applications or other information for device 1150. Specifically, expansion memory 1174 may include instructions to carry out or supplement the processes described above, and may include secure information also. Thus, for example, expansion memory 1174 may be provided as a security module for device 1150, and may be programmed with instructions that permit secure use of device 1150. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 1164, expansion memory 1174, or memory on processor 1152, that may be received, for example, over transceiver 1168 or external interface 1162.

Device 1150 may communicate wirelessly through communication interface 1166, which may include digital signal processing circuitry where necessary. Communication interface 1166 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 1168. In addition, short-range communication may occur, such as using a Bluetooth, WiFi, or other such transceiver (not shown). In addition, GPS (Global Positioning System) receiver module 1170 may provide additional navigation- and location-related wireless data to device 1150, which may be used as appropriate by applications running on device 1150.

Device 1150 may also communicate audibly using audio codec 1160, which may receive spoken information from a user and convert it to usable digital information. Audio codec 1160 may likewise generate audible sound for a user, such as through a speaker, e.g., in a handset of device 1150. Such sound may include sound from voice telephone calls, may include recorded sound (e.g., voice messages, music files, etc.) and may also include sound generated by applications operating on device 1150.

The computing device 1150 may be implemented in a number of different forms, as shown in the figure. For example, it may be implemented as a cellular telephone 1180. It may also be implemented as part of a smart phone 1182, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the invention.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

While certain features of the described implementations have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. A non-transitory computer-readable storage medium comprising instructions stored thereon that, when executed by at least one processor, are configured to cause a computing device to:

in response to an instruction to transition from a first refresh rate to a second refresh rate, modify a transitional frame, the modifying the transitional frame including:

refreshing a first row in a display with a first adjustment to a peak signal of at least one pixel in the first row;

refreshing a second row in the display with a second adjustment to a peak signal of at least one pixel in the second row, the second row being refreshed after the first row, the second adjustment being greater than the first adjustment; and refreshing a third row in the display with a third adjustment to a peak signal of at least one pixel in the third row, the third row being refreshed after the second row, the third adjustment being greater than the second adjustment.

2. The non-transitory computer-readable storage medium of claim 1, wherein the transitional frame includes a last frame displayed at the first refresh rate before transitioning from the first refresh rate to the second refresh rate.

3. The non-transitory computer-readable storage medium of claim 2, wherein the adjustment to the peak signal of the at least one pixel in the second row causes an average luminance of the at least one pixel in the second row to be equal to a predicted average luminance that the at least one pixel in the second row would have had if the first refresh rate had been maintained and the peak signal of the at least one pixel in the second row had not been adjusted.

4. The non-transitory computer-readable storage medium of claim 1, wherein the transitional frame includes a first frame displayed at the second refresh rate after transitioning from the first refresh rate to the second refresh rate.

5. The non-transitory computer-readable storage medium of claim 4, wherein the instructions are further configured to cause the computing device to display a bundled frame after receiving the instruction to transition from the first refresh rate to the second refresh rate, the bundled frame having the first refresh rate and immediately preceding the transitional frame.

6. The non-transitory computer-readable storage medium of claim 5, wherein the adjustment to the peak signal of the at least one pixel in the second row causes an average luminance of the at least one pixel in the second row during the transitional frame and the bundled frame to be equal to a predicted average luminance that the at least one pixel in the second row would have had if the first refresh rate had been maintained and the peak signal of the at least one pixel in the second row had not been adjusted.

7. The non-transitory computer-readable storage medium of claim 1, wherein a distance between the second row and a top portion of the display is greater than a distance between the first row and the top portion of the display.

8. The non-transitory computer-readable storage medium of claim 1, wherein the first adjustment is zero.

9. The non-transitory computer-readable storage medium of claim 1, wherein a sign of the second adjustment is based on an encoded intensity of the at least one pixel in the second row.

10. The non-transitory computer-readable storage medium of claim 1, wherein the second adjustment is based on a location in the display of the second row and an encoded intensity of the at least one pixel in the second row.

11. The non-transitory computer-readable storage medium of claim 1, wherein the second adjustment is based on a location in the display of the second row, an encoded intensity of the at least one pixel in the second row, and a measured temperature of the display.

12. The non-transitory computer-readable storage medium of claim 1, wherein the second adjustment is based on a location in the display of the second row and a measured temperature of the display.

13. The non-transitory computer-readable storage medium of claim 1, wherein:

the second refresh rate is greater than the first refresh rate; and the second adjustment is a negative value.

14. The non-transitory computer-readable storage medium of claim 1, wherein:

the second refresh rate is greater than the first refresh rate;

an encoded intensity of the at least one pixel in the second row is within a high luminance range; and the second adjustment is a negative value.

15. The non-transitory computer-readable storage medium of claim 1, wherein:

the second refresh rate is greater than the first refresh rate;

an encoded intensity of the at least one pixel in the second row is within a low luminance range; and the second adjustment is a positive value.

16. The non-transitory computer-readable storage medium of claim 1, wherein:

an encoded intensity of the at least one pixel in the second row is within a medium luminance range; and the second adjustment is zero.

17. A computing device comprising:

at least one processor; and a non-transitory computer readable storage medium comprising instructions stored thereon that, then executed by the at least one processor, are configured to cause the computing device to:

in response to an instruction to transition from a first refresh rate to a second refresh rate, modify a transitional frame, the modifying the transitional frame including:

refreshing a first row in a display with a first adjustment to a peak signal of at least one pixel in the first row;

refreshing a second row in the display with a second adjustment to a peak signal of at least one pixel in the second row, the second row being refreshed after the first row, the second adjustment being greater than the first adjustment; and refreshing a third row in the display with a third adjustment to a peak signal of at least one pixel in the third row, the third row being refreshed after the second row, the third adjustment being greater than the second adjustment.

18. The computing device of claim 17, wherein the transitional frame includes a last frame displayed at the first refresh rate before transitioning from the first refresh rate to the second refresh rate.

19. The computing device of claim 18, wherein the adjustment to the peak signal of the at least one pixel in the second row causes an average luminance of the at least one pixel in the second row to be equal to a predicted average luminance that the at least one pixel in the second row would have had if the first refresh rate had been maintained and the peak signal of the at least one pixel in the second row had not been adjusted.

20. A method comprising:

in response to an instruction to transition from a first refresh rate to a second refresh rate, modifying, by a computing device, a transitional frame, the modifying the transitional frame including:

refreshing a first row in a display with a first adjustment to a peak signal of at least one pixel in the first row;

refreshing a second row in the display with a second adjustment to a peak signal of at least one pixel in the second row, the second row being refreshed after the first row, the second adjustment being greater than the first adjustment; and refreshing a third row in the display with a third adjustment to a peak signal of at least one pixel in the third row, the third row being refreshed after the second row, the third adjustment being greater than the second adjustment.

* * * * *